US006703892B1

(12) United States Patent
Capofreddi et al.

(10) Patent No.: US 6,703,892 B1
(45) Date of Patent: Mar. 9, 2004

(54) MECHANISM FOR COUPLING A WIDEBAND CURRENT SIGNAL BETWEEN TWO DIFFERENT POTENTIALS

(75) Inventors: Peter Capofreddi, San Francisco, CA (US); Anu Pisipaty, San Jose, CA (US)

(73) Assignee: Santel Networks, Inc., Newark, CA (US)

( * ) Notice: Subject to any disclaimer, the term of this patent is extended or adjusted under 35 U.S.C. 154(b) by 0 days.

(21) Appl. No.: 10/236,672

(22) Filed: Sep. 6, 2002

(51) Int. Cl.[7] ..... G05F 1/10
(52) U.S. Cl. ..... 327/538
(58) Field of Search ..... 327/530, 534, 327/535, 537, 538, 540, 541, 543

(56) References Cited

U.S. PATENT DOCUMENTS 6,324,388 B1 * 11/2001 Souetinov ..... 455/302

* cited by examiner

*Primary Examiner*—Jeffrey Zweizig
(74) *Attorney, Agent, or Firm*—Blakely Sokoloff Taylor & Zafman LLP

(57) ABSTRACT

An apparatus for coupling a wideband current signal between two different potentials. The apparatus incorporates a capacitor for providing a signal path for a high frequency signal from a first potential to a second potential. The apparatus further incorporates a current mirror for providing a signal path to a low frequency signal from the first potential to the second potential.

34 Claims, 7 Drawing Sheets

MECHANISM FOR COUPLING A WIDEBAND CURRENT SIGNAL BETWEEN TWO DIFFERENT POTENTIALS

FIELD OF THE INVENTION

The present invention relates to a coupling mechanism for coupling a signal current including a high-frequency signal component and a low-frequency signal component between two different potentials.

BACKGROUND OF THE INVENTION

A consequence of the progression to shorter channel lengths and thinner gate oxides in MOS technology is that supply voltages become progressively lower. This is due primarily to lower breakdown voltage of thinner gate oxides. In analog signal processing circuits, lower supply voltages present a number of serious difficulties.

One such difficulty, sometimes referred to as the "stacking problem", can be understood by considering the example of a Gilbert-Cell multiplier 10, shown in FIG. 1. In the Gilbert-Cell multiplier 10, a differential input voltage $V_{in}$ is converted to a differential current $i_a$ using a transconductance stage comprising transistors 11 and 12, resistors 14 and 16, and current source 18. The relationship between $i_a$ and $V_{in}$ is approximately $$i_a = g_m V_{in}$$

The current $i_a$ is then steered using transistors 20, 22, 24 and 26 in such a way that a fraction k of the current goes through the left path and a fraction l-k goes through the right path. This produces an output current $i_o$ which is proportional to the product of $V_{in}$ and k, $$i_o = g_m k V_{in}$$

thus performing a multiplication operation.

The problem is that because the transistors are "stacked" in such a way that the same current signal flows through both a bottom transistor (11–12) and a top transistor (20, 22, 24 and 26), the supply voltage must be large enough to accommodate the collector-emitter drops for both transistors. The problem can be solved in some cases by "unstacking" the Gilbert-Cell into two separate stages and capacitively coupling the two stages together, as shown in FIG. 2. Capacitors 50 and 52 provide DC isolation, allowing the common mode voltage to be different in the two stages, while also providing AC connectivity, passing the signal current between the stages. Current sources 46 and 48 provide a DC path for the current generated in the transconductance stage.

The primary problem with the capacitive coupling method of "unstacking" is that the coupling capacitor limits the band of frequencies the circuit can accommodate. The circuit no longer passes DC signals at all, and low frequency signals are highly attenuated. For many applications, such as radio, this is not a significant problem, because the signals do not extend all the way down to DC. In the case where the signal represents baseband data, for example in optical networking, the inability to pass DC and low frequency signals is a very significant problem, however.

In some cases, the current sources 48 and 46 can be implemented with resistors. This is because the input to the second stage has a low impedance, so that the voltage swing at the output of the first stage is small.

In some cases, the capacitive coupling method requires a common-mode control circuit (not shown in FIG. 2) to set the DC common mode voltage level of the first stage.

Thus, there exists a need in analog signal processing for a coupling mechanism between two different potentials that transmits DC signals as well as AC signals between the two different potentials even in a situation where the supply voltage is low.

SUMMARY OF THE INVENTION

In one embodiment, the invention is an apparatus for coupling a wideband current signal between two different potentials. The apparatus incorporates a capacitor for providing a signal path for a high frequency signal from a first potential to a second potential. The apparatus further incorporates a current mirror for providing a signal path to a low frequency signal from the first potential to the second potential.

In an alternate embodiment, the invention is a method for coupling a signal current between a first potential and a second potential. The method includes receiving a high frequency signal from the first potential. The method also includes receiving a low frequency signal from the first potential. The method further includes transmitting the high frequency signal via a high frequency signal path to the second potential. Moreover, the method includes transmitting the low frequency signal via a low frequency signal path to the second potential.

BRIEF DESCRIPTION OF THE DRAWINGS

The present invention is illustrated by way of example, and not limitation, in the figures of the accompanying drawings in which like reference numerals indicate similar elements and in which.

DETAILED DESCRIPTION

Described herein is a technique for coupling a wideband current signal between two different potentials. Specifically, according to the methods and apparatus of the present invention, a high-frequency path, implemented by a capacitor, and a low frequency path, implemented by a current mirror are provided for delivering both the AC and the DC signals.

Although the present invention will be discussed below with reference to presently preferred embodiments, it should be remembered that this discussion is not meant to limit the scope of the present invention to those specific embodiments. Rather, the discussion of these specific embodiments is being provided in order to describe, in a fashion intended for those of ordinary skill in the art, the presently known best mode for practicing the invention. Others having had the benefit of this disclosure may realize additional embodiments that represent insubstantial difference from those disclosed herein. Such embodiments are intended to fall within the ambit of the present invention. Therefore, when measuring the true scope of the present invention, readers should refer to the claims that follow this detailed description, and use this description only to enhance their understanding of those claims.

The present invention provides a mechanism for coupling a signal current between two different potentials. The mechanism includes the transmission of both AC and DC.

Figure 3:
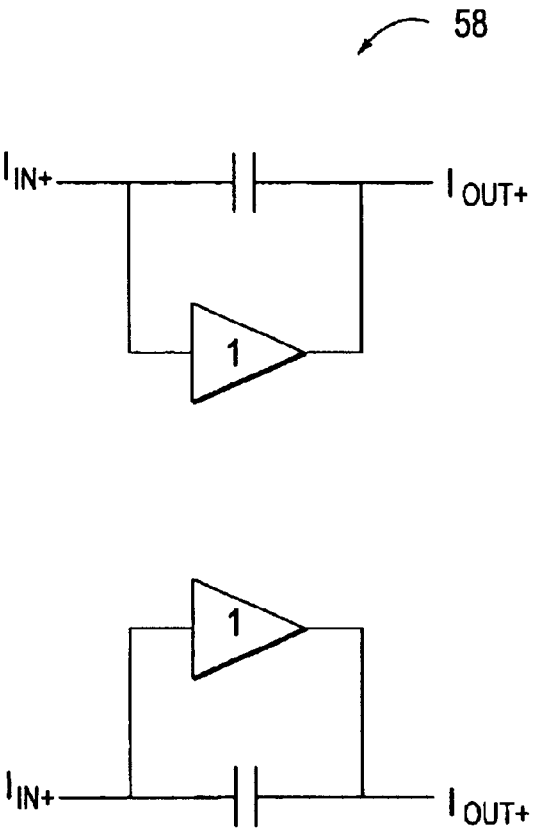
FIG. 3 is a block diagram illustrating one embodiment of a coupling apparatus 58 in accordance with the present invention.

FIG. 3 is a block diagram illustrating one embodiment of a coupling apparatus 58 in accordance with the present invention. In this example, a differential current signal Iin is received from a first stage (not shown) and a differential current signal Iout is transmitted to a second stage (not shown). Two signal paths are provided to represent respectively the positive and negative polarity of the differential signal. Within each of these two signal paths, two subpaths are provided: a high-frequency subpath, implemented by a capacitor, and a low frequency subpath, implemented by a current mirror. The high frequency part of the input current is coupled directly to the output with the capacitor. The gain in this path is one (0 dB) by virtue of Kirchoff's current law. The low frequency path is therefore also designed to have a gain of one. This results in a transfer function for the coupling stage that maintains an essentially flat unity current gain from DC all the way out to tens of GHz.

Figure 4:
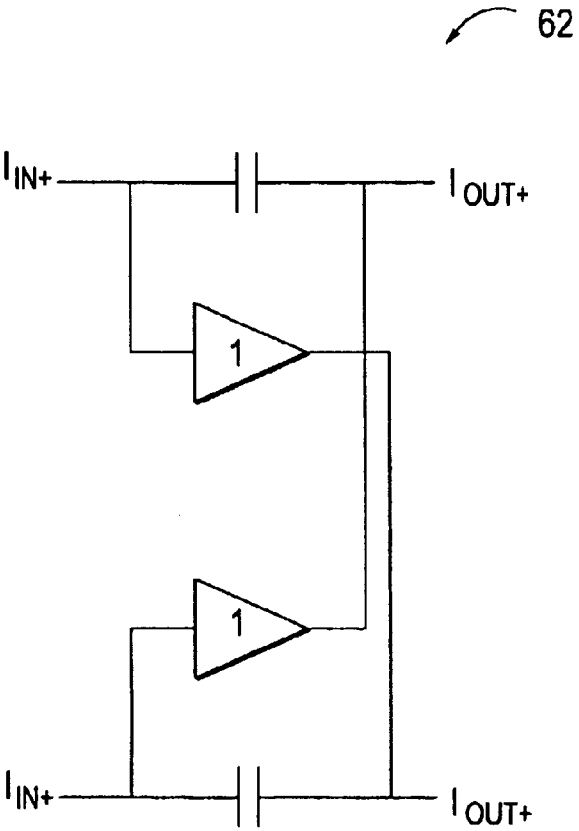
FIG. 4 is a block diagram illustrating an alternative embodiment of the coupling apparatus in accordance with the present invention.

FIG. 4 is a block diagram illustrating an alternative embodiment of the coupling apparatus 62 in accordance with the present invention. The low frequency path is designed to have a gain of −1, but the outputs of the current mirrors are "cross-coupled" between the differential paths, resulting in an effective gain of one in the low frequency path. The embodiment of FIG. 4 is preferred because it is more straightforward to design a current mirror with a gain of −1 than with a gain of +1, for implementation reasons that are well known in the art.

Figure 5:
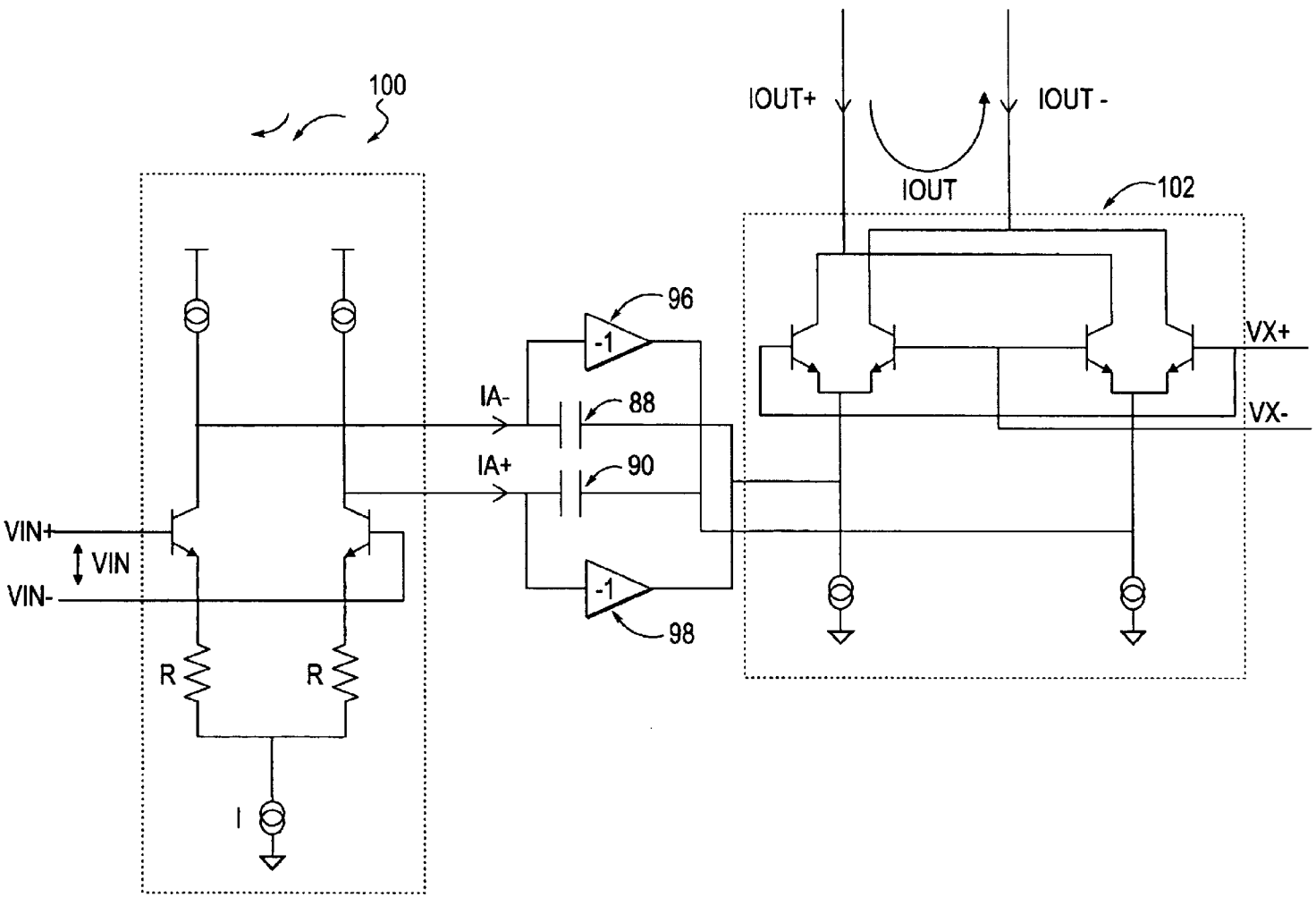
FIG. 5 is a block diagram illustrating an embodiment of the coupling apparatus configured in accordance with the present invention and incorporated into a Gilbert-Cell multiplier.

FIG. 5 is a block diagram illustrating an embodiment of the coupling apparatus configured in accordance with the present invention and incorporated into a Gilbert-Cell multiplier. High frequency coupling capacitors 88 and 90 pass high frequency components of the signal from stage 100 to stage 102. Current mirrors 96 and 98 pass low frequency components of the signal from stage 100 to stage 102.

Figure 1:
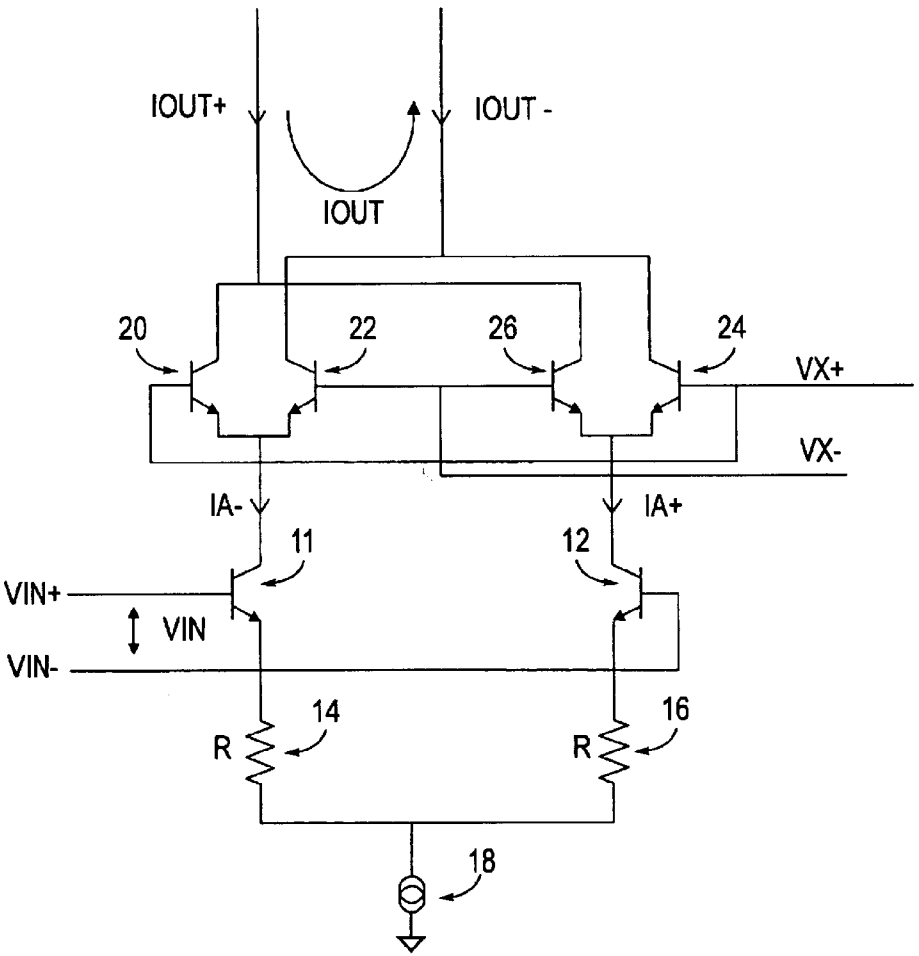
FIG. 1 (Prior Art)
FIG. 1 is a block diagram illustrating a Gilbert cell multiplier.

The advantages of the circuit of FIG. 5 over that of FIG. 1 are: (1) the circuit can operate at a lower supply voltage since the transistors are "unstacked"; (2) different common-mode currents can be used in different stages to reduce power consumption.

Figure 2:
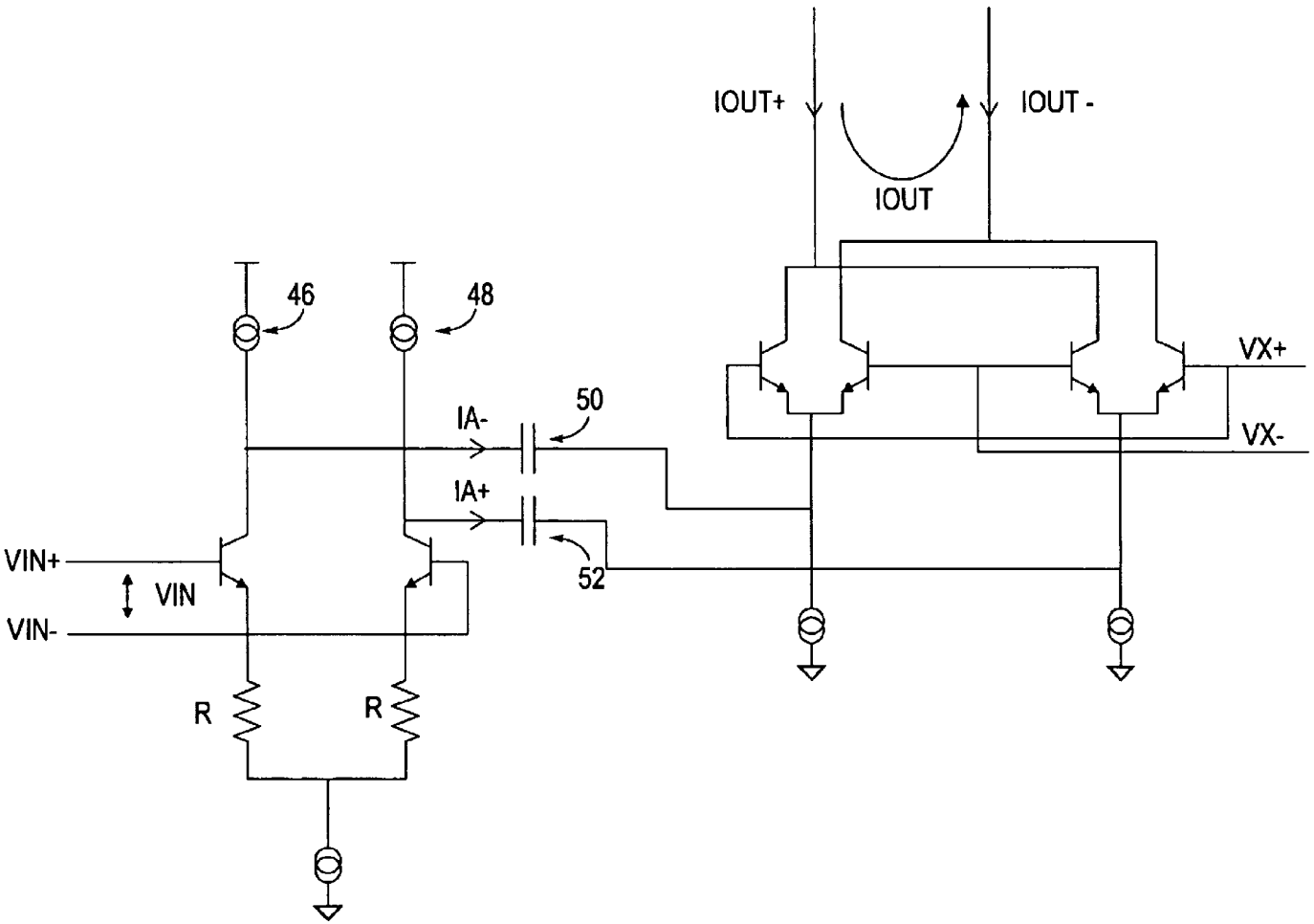
FIG. 2 (Prior Art)
FIG. 2 is a block diagram illustrating an unstacked Gilbert cell multiplier.

The advantages of the circuit of FIG. 5 over that of FIG. 2 are: (1) the input signal bandwidth extends all the way down to DC; (2) a smaller coupling capacitor can be used, thereby saving area and reducing parasitics; (3) a common mode control circuit is not required because the current mirror stage has a low-impedance input that sets the bias point of the first stage.

Figure 6:
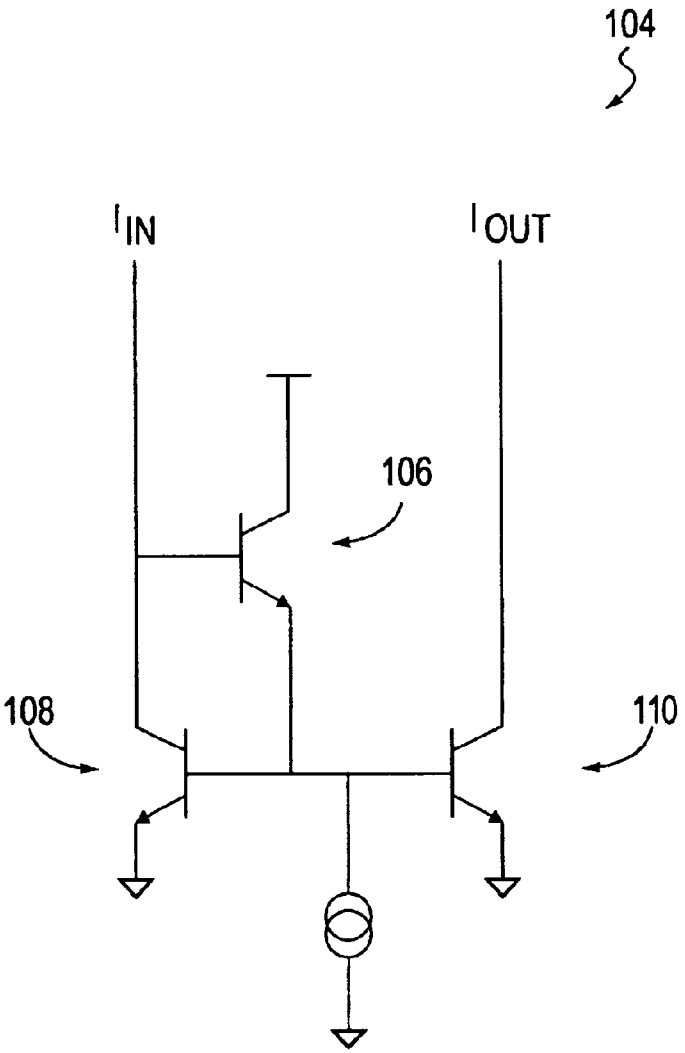
FIG. 6 is a block diagram a conventional current mirror.

FIG. 6 is a block diagram of a conventional current mirror 104. In implementing the current mirror 104 for the low frequency path, an important consideration is that the current mirror 104 does not load down the high frequency path with parasitic capacitances. This requires careful attention to the input and output nodes of the mirror circuit. In particular, for very high bandwidth BiCMOS applications, it is necessary to use bipolar transistors at the input and output of the current mirror 104. Internal to the current mirror 104 it is possible to use MOS transistors. One circuit that satisfies this design criterion is the current mirror 104 illustrated in FIG. 6. The operation of this circuit is described in detail in P. R. Gray et al., *Analysis and Design of Analog Integrated Circuits*, Wiley, 1984, p. 237, and can be summarized as follows. By virtue of the fact that nominally identical transistors 108 and 110 have the same base-emitter voltage, they will generate approximately the same collector current. This results in a current gain of −1. Transistors 106 and 108 comprise a feedback loop that creates a low source impedance at the input of the current mirror 104. The DC bias voltage at the input of the current mirror 104 is maintained at the ground potential plus twice the base-emitter voltage (2*Vbe).

Figure 7:
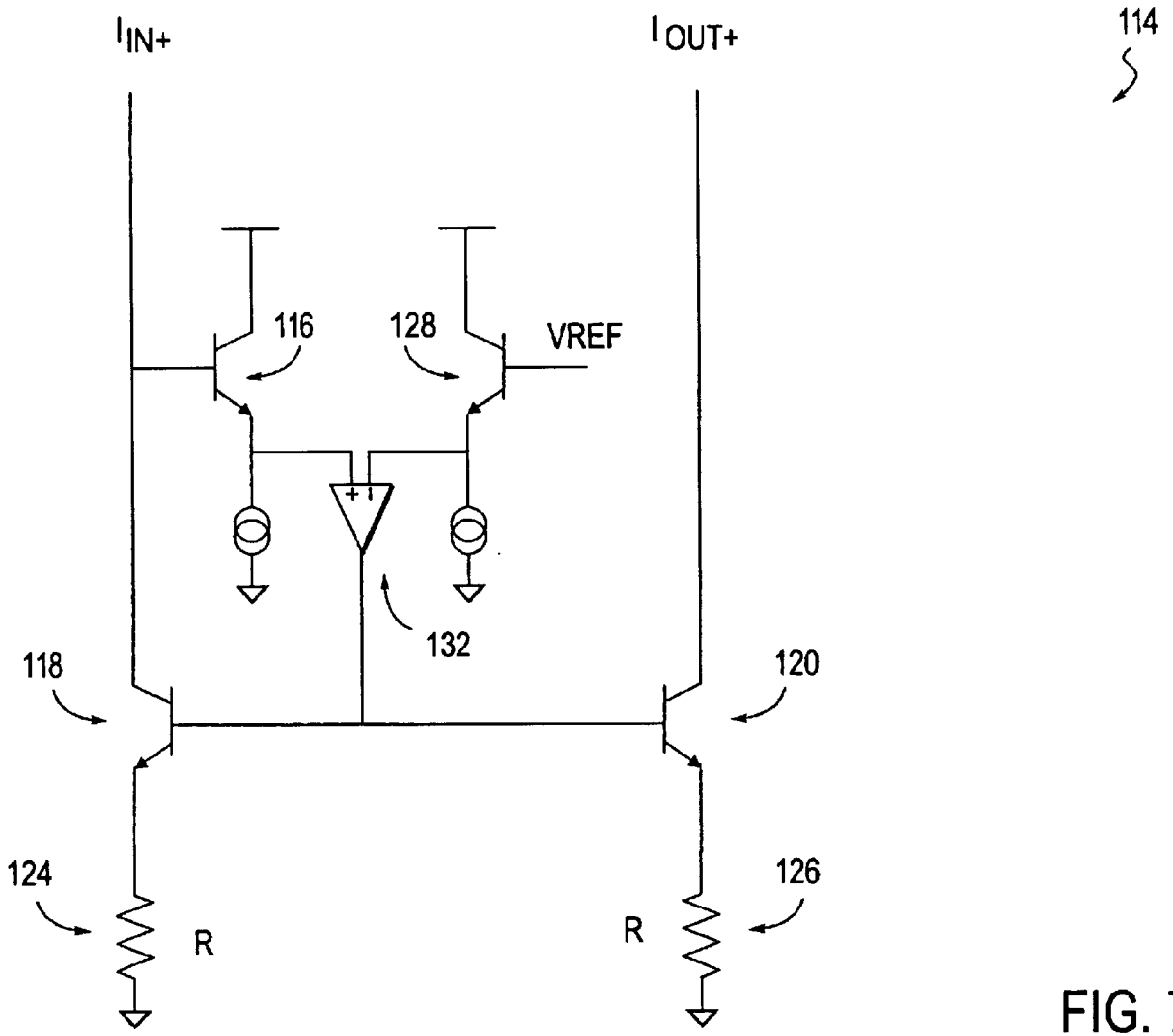
FIG. 7 is a block diagram of an improved current mirror circuit utilized by the present invention.

The current mirror 104 of FIG. 6 suffers from some important disadvantages that have motivated the inventors to develop an improved current mirror 114 (see FIG. 7). Chief among these disadvantages are: (1) thermal noise from the base resistance of transistors 106–110 has a very high gain to the output, resulting in poor noise performance; (2) offset between transistors 108 and 110 results in a large error in the DC current; (3) the bias voltage of the input is set by the ground potential and the base-emitter voltage, whereas it is often desirable to have a bias voltage that depends in a different way on process and supply.

FIG. 7 is a block diagram of an improved current mirror 114 circuit utilized by the present invention. The improved current mirror circuit 114 in FIG. 7 addresses these three problems. Transistors 116 and 128, used as emitter followers, in conjunction with operational amplifier 132, amplify the difference between the input voltage and a reference voltage VREF. The amplified difference is fed to the bases of transistors 118 and 120, which then generate a current proportional to the difference. Since degeneration resistors 124 and 126 are nominally identical and transistors 118 and 120 are nominally identical, the currents in the input and output path are nominally equal, resulting in a gain of −1. The input impedance is given approximately by $R_{in}=R/A_v$, where $A_v$, is the voltage gain of the op amp. Because the gain $A_v$ is large, large degeneration resistors 124 and 126 can be used to reduce the noise gain and the effect of transistor offsets without significantly increasing the input impedance.

Figure 8:
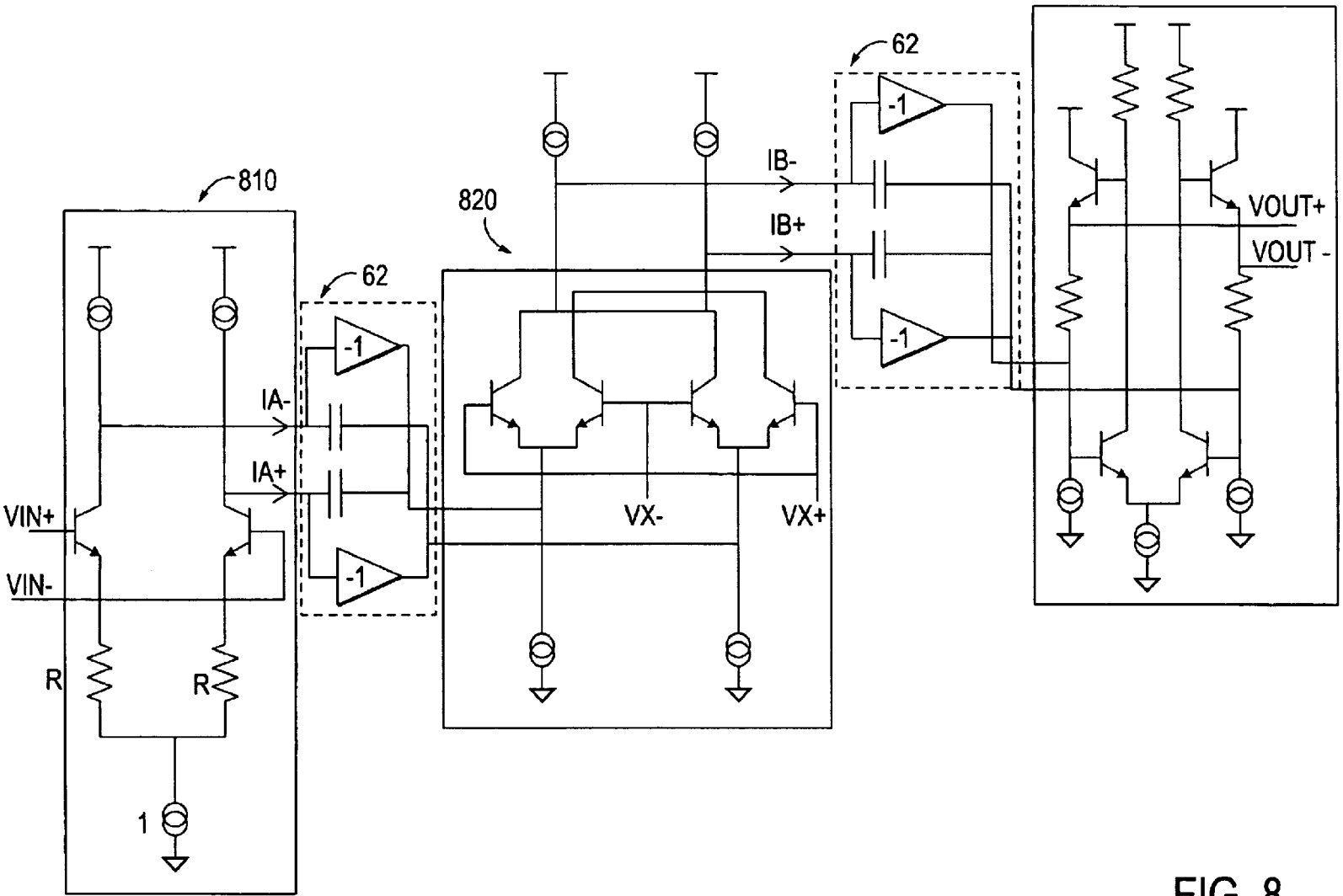
FIG. 8 is a block diagram illustrating the application of the invention in a 3.3-volt supply 10 GBit/s variable gain amplifier (VGA) stage for optical networking applications.

FIG. 8 is a block diagram illustrating the application of the invention in a 3.3-volt supply 10 GBit/s variable gain amplifier (VGA) stage for optical networking applications. The ability to use such a low supply voltage results from the separation of the VGA stage into three substages. The substages are coupled together using the invention. The first substage 810 is a transconductance stage that converts the input voltage into a current. The second substage 820 is a variable attenuator stage that multiplies the signal current generated by substage 810 by a fraction k determined by the control voltage VX. The third substage is a transimpedance stage that converts the current back into a voltage.

What is claimed is:

1. An apparatus, comprising:

a first capacitor coupled to provide a first high frequency signal path for a high frequency signal from a first signal processing stage operative at a first potential to a second signal processing stage operative at a second potential; and a first current mirror coupled to provide a first low frequency signal path for a low frequency signal from the first signal processing stage to the second signal processing stage.

2. The apparatus of claim 1 wherein the first current mirror comprises:

an amplifier coupled to provide an output signal representing a difference between an input voltage and a reference voltage; and an output node coupled to a transistor that is configured to receive the output signal as a base voltage, the output node being maintained at a current equal to that at an input node which is configured to provide the input voltage.

3. The apparatus of claim 1 further comprises:

a second capacitor coupled to provide a second high frequency signal path for the high frequency signal from the first signal processing stage to the second signal processing stage; and a second current mirror coupled to provide a second low frequency signal path for the low frequency signal from the first signal processing stage to the second signal processing stage.

4. The apparatus of claim 3 wherein the output node of the first current mirror is cross coupled with an output node of the second current mirror, resulting in an effective gain of +1.

5. The apparatus of claim 1 wherein the first signal processing stage comprises an amplifier stage.

6. The apparatus of claim 1 wherein the second signal processing stage comprises an amplifier stage.

7. The apparatus of claim 1 further comprises:

a capacitor coupled to provide a signal path for a high frequency signal from the second signal processing stage to a third signal processing stage operative at a third potential; and a current mirror coupled to provide a signal path for a low frequency signal from the second signal processing stage to the third signal processing stage.

8. The apparatus of claim 7 wherein the first signal processing stage, second signal processing stage, and third signal processing stage are coupled to form a variable gain amplifier.

9. A current mirror, comprising:

a plurality of first transistors, coupled as emitter followers;

an operational amplifier, coupled to provide a difference signal representing a difference between an input voltage provided by one of the emitter followers and a reference voltage provided by another of the emitter followers;

a plurality of second transistors, coupled to receive the difference signal as a control voltage; and a plurality of resistors, each coupled to a respective one of the second transistors to provide a current path to ground.

10. The current mirror of claim 9 wherein the first transistors have a voltage source coupled to provide an input voltage.

11. The current mirror of claim 9 wherein the first transistors are coupled to the operational amplifier.

12. The current mirror of claim 9 wherein the operational amplifier is coupled to the second transistors.

13. The current mirror of claim 9 wherein an output node is coupled to one of the second transistors, and the one of the second transistors is configured to receive an output signal as a base voltage.

14. The current mirror of claim 13 wherein the output node is maintained at a current equal to that at an input node which is configured to provide the input voltage.

15. The current mirror of claim 13 wherein the output node is cross coupled with the output of a second current mirror, resulting in an effective gain of +1.

16. A method for coupling a current signal between signal processing stages, comprising:

providing a first high frequency signal path for a high frequency current signal from a first signal processing stage operative at a first potential to a second signal processing stage operative at a second potential; and providing a first low frequency signal path for a low frequency current signal from the first signal processing stage to the second signal processing stage.

17. The method of claim 16 further comprises receiving a high frequency current signal at the first high frequency signal path.

18. The method of claim 17 further comprises transmitting the high frequency current signal received to the second signal processing stage.

19. The method of claim 16 wherein the first high frequency signal path utilizes a capacitor.

20. The method of claim 16 further comprises receiving a low frequency current signal at the first low frequency signal path.

21. The method of claim 20 further comprises transmitting the low frequency current signal received to the second signal processing stage.

22. The method of claim 16 wherein the low frequency current signal transmitted is equal to the low frequency current signal received.

23. The method of claim 22 wherein the first low frequency signal path utilizes a current mirror.

24. The method of claim 16 wherein the first signal processing stage and the second signal processing stage use different common-mode currents.

25. The method of claim 16 further comprises:

providing a second high frequency signal path for the high frequency current signal from the first signal processing stage to the second signal processing stage; and providing a second low frequency signal path for the low frequency current signal from the first signal processing stage to the second signal processing stage.

26. The method of claim 25 wherein the second low frequency signal path utilizes a current mirror.

27. The method of claim 25 wherein an output node of the first low frequency signal path is cross coupled with an output node of second low frequency signal path.

28. The method of claim 16 wherein the first signal processing stage comprises an amplifier stage.

29. The method of claim 16 wherein the second signal processing stage comprises an amplifier stage.

30. A method of coupling a current signal between a first signal processing stage and a second signal processing stage utilizing a low frequency path, comprising:

receiving a current signal;

receiving an input voltage;

amplifying the difference between the input voltage and a reference voltage;

generating a current signal proportional to the amplified difference; and transmitting the generated current signal to a second signal processing stage.

31. The method of claim 30 wherein the low frequency current signal transmitted is equal to the low frequency current signal received.

32. The method of claim 30 wherein the first signal processing stage is operative at a first potential and the second signal processing stage is operative at a second potential.

33. The method of claim 30 wherein transmitting the generated current signal comprises transmitting via an output node wherein the output node is cross coupled with a second low frequency path's output node.

34. The method of claim 33 wherein a gain of +1 is realized.

* * * * *